United States Patent [19]

Maruyama et al.

[11] 4,394,114

[45] Jul. 19, 1983

[54] COMPRESSOR

[75] Inventors: Teruo Maruyama, Neyagawa; Tadayuki Onoda, Toyonaka; Tatsuhisa Taguchi, Shiga, all of Japan

[73] Assignee: Matsushita Electric Industrial Co., Ltd., Kadoma, Japan

[21] Appl. No.: 247,084

[22] Filed: Mar. 24, 1981

[30] Foreign Application Priority Data

Mar. 27, 1980 [JP] Japan ..... 55-39729

[51] Int. Cl.[3] ..... F03C 2/00

[52] U.S. Cl. ..... 418/269; 418/88

[58] Field of Search ..... 418/98, 88, 93, 269, 418/268

[56] References Cited

U.S. PATENT DOCUMENTS

| | | | |
|---|---|---|---|
| 1,023,820 | 4/1912 | Dennison | 418/98 |
| 1,914,091 | 6/1933 | Hamilton et al. | 418/268 |
| 1,953,253 | 4/1934 | Ogilvie | 418/93 |
| 2,094,323 | 9/1937 | Kenney et al. | 418/88 |
| 3,385,513 | 5/1968 | Kilgore | 418/98 |
| 3,513,476 | 5/1970 | Monden et al. | 418/88 |
| 3,988,080 | 10/1976 | Takada | 418/98 |

FOREIGN PATENT DOCUMENTS

| | | | |
|---|---|---|---|
| 779463 | 1/1935 | France | 418/269 |

*Primary Examiner*—Charles J. Myhre
*Assistant Examiner*—Magdalen Moy
*Attorney, Agent, or Firm*—Wenderoth, Lind & Ponack

[57] ABSTRACT

A rotary compressor of the sliding vane type which is constructed to prevent seizure during high speed operation, with increased volume efficiency through reduction of leakage of refrigerant, and simultaneous improvements in refrigeration cycle efficiency by the prevention of entry of oil into the refrigeration cycle.

10 Claims, 9 Drawing Figures

COMPRESSOR

The present invention generally relates to a compressor and more particularly, to a rotary type compressor which is constructed to prevent undesirable seizure, especially during operation at high speeds.

Figure 1:
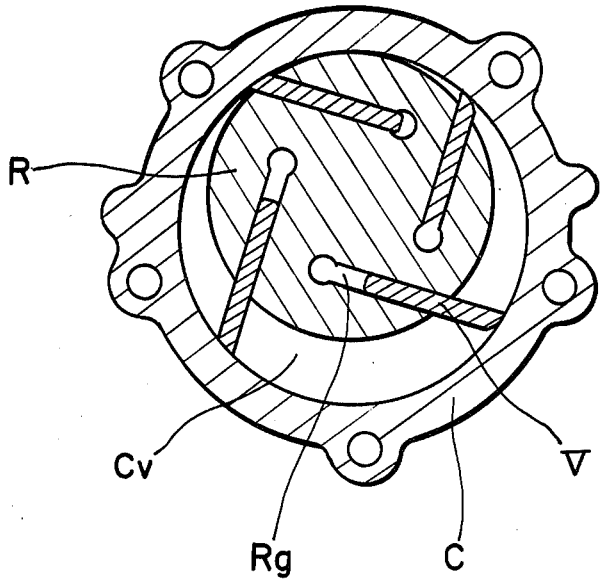
Fig. 1 PRIOR ART

Recently, to achieve simplification of construction, higher operating efficiency, and low noise during operations, etc., rotary compressors of the sliding vane type have come to be used, for example, for air-conditioning apparatuses employed in motor vehicles such as the so-called "car coolers" and the like. As shown in FIG. 1, a rotary type compressor generally includes a cylinder C having a cylindrical space or bore constituting a vane chamber Cv formed therein, end walls (not shown) secured to opposite end faces of said cylinder C for closing the vane chamber Cv thereat, a rotor R movably provided within said cylinder C for eccentric movements in said cylinder C, and a plurality of vanes V slidably fitted into corresponding grooves Rg formed in said rotor R.

A lighter weight for motor vehicles has been actively sought in recent years due to the trend to energy conservation and savings in resources resulting in increasing demands for lighter weight and compact size of the compressor to be mounted on the motor vehicle.

With a compact rotary type compressor, it is most effective to drive the compressor at high speeds in order to achieve the desired discharge rate, and thus, it has been necessary to increase the maximum speed from at about 8,000 r.p.m. in a conventional arrangement up to approximately 12,000 r.p.m. As a result, troubles due to seizure of the sliding portions within the compressor, especially between the rotor R and the side walls during high speed operation of the compressor, have occurred.

In the conventional arrangements, although a layer of lubrication oil in which refrigerant is dissolved is normally present between the rotor R and side walls of the compressor, the oil layer is considered to be formed only by a "heat wedge" action. The "heat wedge" action is a phenomenon in which pressure generation is available even in perfectly parallel planes, and which results from a temperature rise due to shearing action, expansion of lubrication oil due to the temperature rise, and also lowering of the density, in the case where the lubrication oil flows over the lubricating surface. However, the load capacity due to the "heat wedge" action as described above is extremely small, and during high speed operations in which lubricating conditions deteriorate due to temperature rise on the lubricating surface and increased sliding speeds and also the clearance between the relative moving surfaces is reduced due to thermal expansion, it has been difficult to prevent seizure.

In connection with the above, it may be possible to increase the margin of safety against the seizure by making the clearance between the rotor R and side walls somewhat larger than necessary for preventing mechanical contact between sliding portions due to breakage of the oil layer. As a result, however, leakage of the refrigerant within the compressor tends to be increased, with consequent marked reduction of volume efficiency especially during low speed operation and also reduction of refrigeration cycle efficiency due to entry of oil into the refrigeration cycle, thus bringing about another problem incompatible with the problem of prevention of seizure during the high speed operation.

Accordingly, an essential object of the present invention is to provide a rotary compressor of the sliding vane type which is constructed to prevent seizure during high speed rotations, which has increased volume efficiency due to reduction of leakage of refrigerant, and simultaneous improvements in refrigeration cycle efficiency due to the prevention of entry of oil into the refrigeration cycle.

Another important object of the present invention is to provide a rotary compressor of the above described type which has a simple construction and is stable in operation and has high reliability, and can be produced on a large scale at low cost.

In accomplishing these and other objects, according to one preferred embodiment of the present invention, there is provided a compressor which includes a rotor, a plurality of vanes slidably mounted in corresponding sliding grooves or slits formed in the rotor, a rotor shaft for rotatably supporting the rotor, a cylinder accommodating the rotor and vanes therein, end plates secured to opposite ends of the cylinder for defining a vane chamber formed by the cylinder, rotor and vanes, and annular or ring-like grooves for supplying lubricating fluid under high pressure into the sliding grooves so as to stabilize movement of the vanes. The annular grooves are each formed between relatively moving surfaces of the rotor and corresponding one of the end plates, and a dynamic pressure type fluid thrust bearing having shallow grooves is formed in each of the relatively moving surfaces in a position between the annular groove and the rotor shaft.

By the arrangement according to the present invention as described above, there has been provided an improved rotary compressor of the sliding vane type which is not subject to seizure during high speed operations and yet which has improved volume efficiency and refrigeration cycle efficiency.

Figure 2:
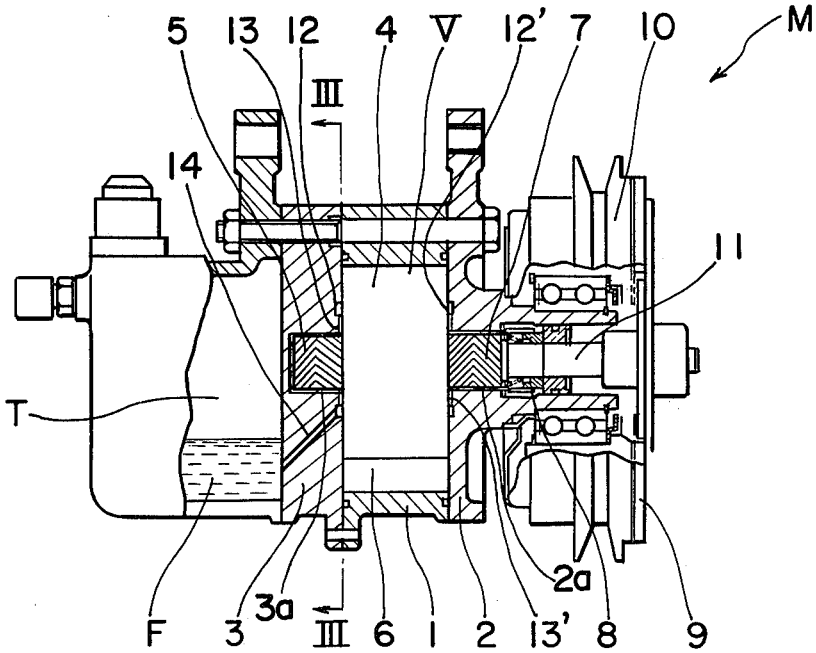
Figure 3:
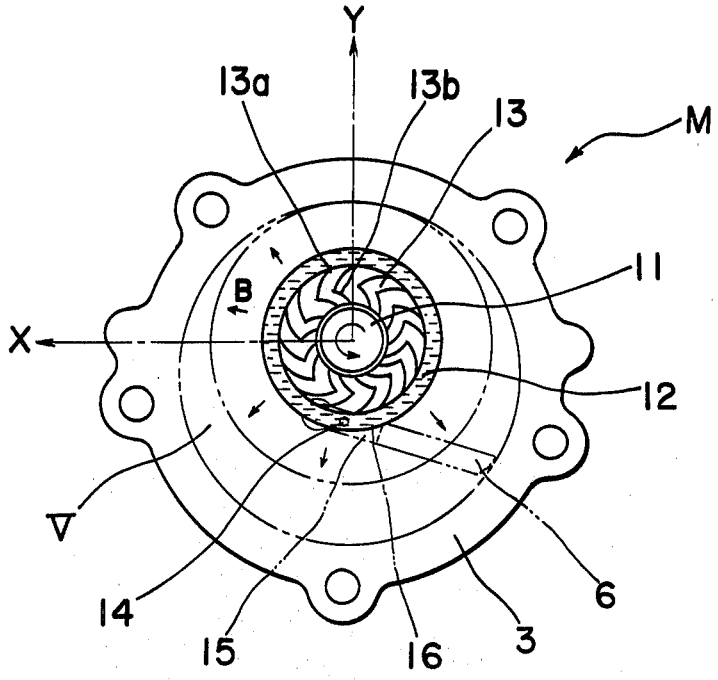
Figure 3:
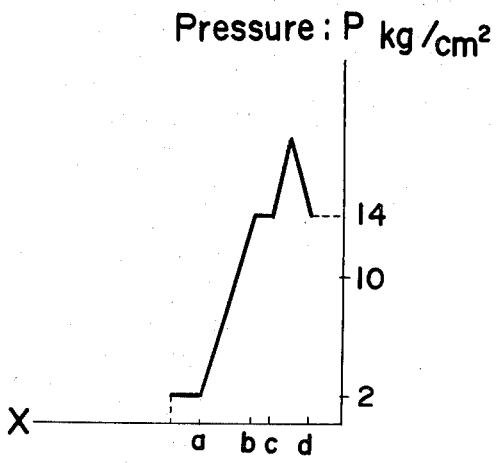
Figure 4:
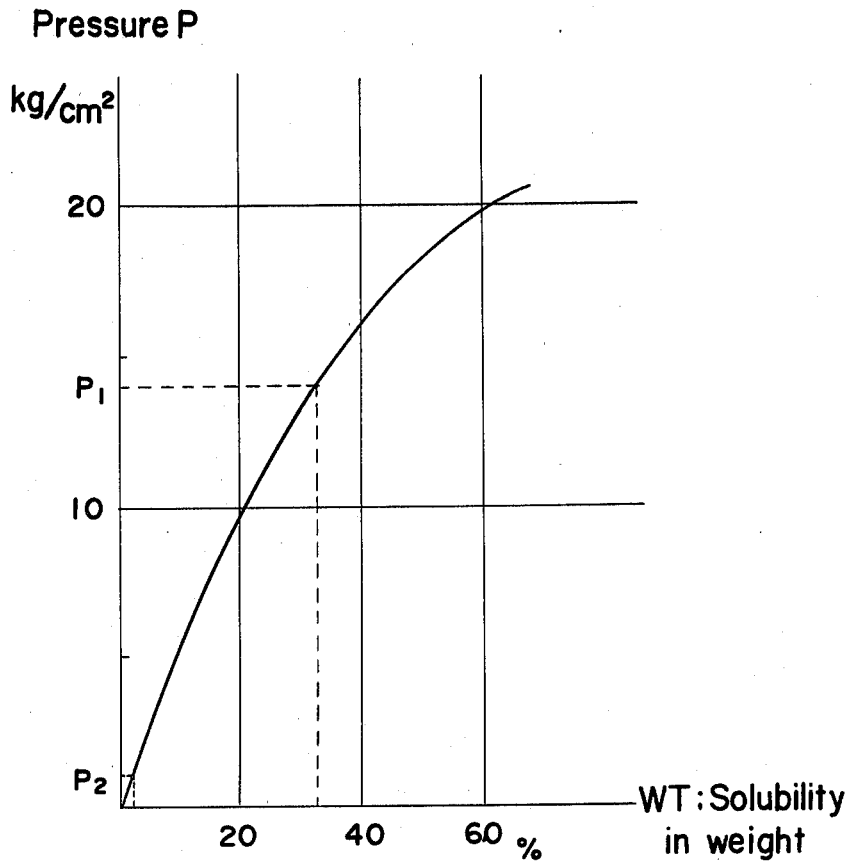
Figure 5:
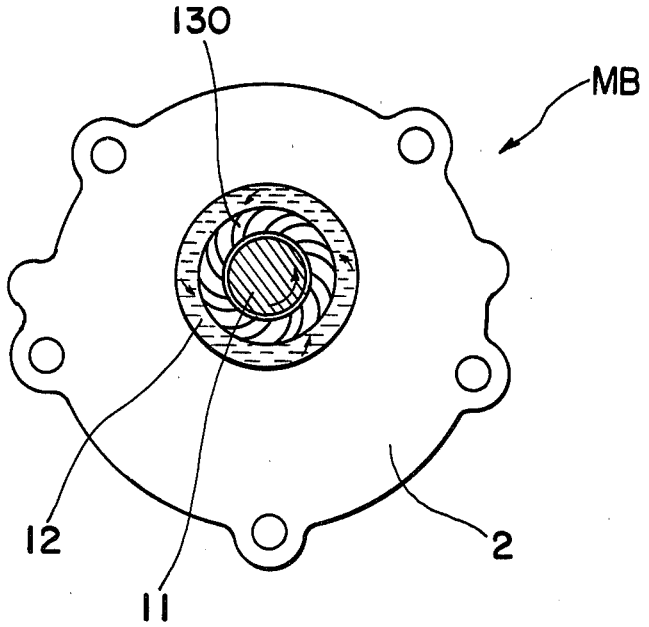
Figure 5:
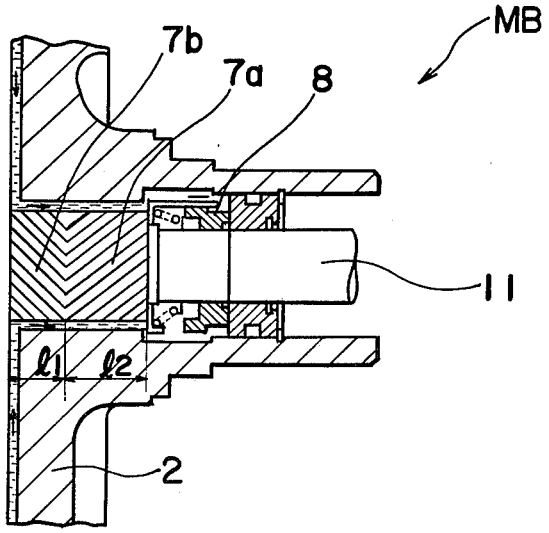
Figure 6:
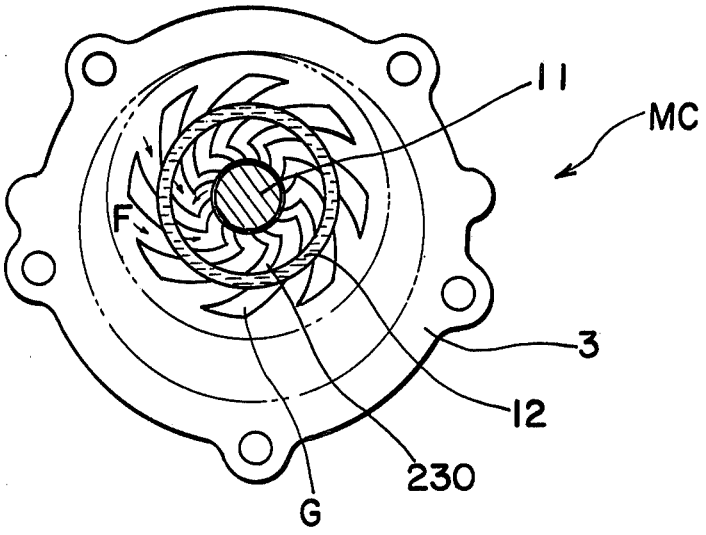
Figure 7:
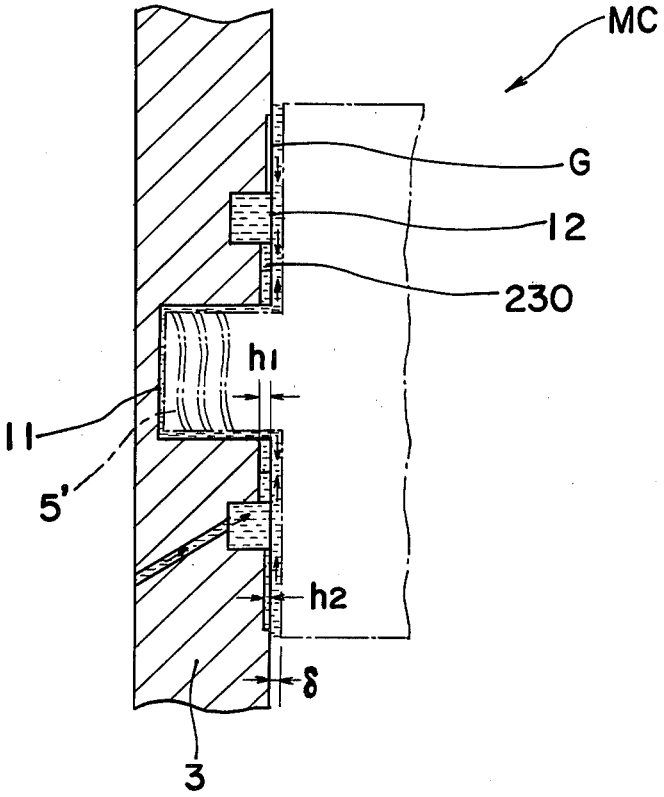

These and other objects and features of the present invention will become apparent from the following description of preferred embodiments thereof and with reference to the accompanying drawings, in which;

FIG. 1 is a front sectional view of a conventional rotary compressor of the sliding vane type (already referred to), FIG. 2 is a side elevational view, partly broken away and in section, of a compressor according to one preferred embodiment of the present invention, FIG. 3(*a*) is a schematic sectional diagram taken along the line III—III of FIG. 2, FIG. 3(*b*) is a graph for explaining the functioning of the compressor of FIG. 2, FIG. 4 is a graph for explaining the relation between the solubility of the refrigerant and pressures, FIG. 5(*a*) is a schematic sectional diagram of a compressor according to a modification of the present invention, FIG. 5(*b*) is a fragmentary side sectional view showing, on an enlarged scale, an essential portion of the compressor of FIG. 5(*a*), FIG. 6 is a diagram similar to FIG. 5(*a*), which particularly shows another modification thereof, and FIG. 7 is a fragmentary side sectional view showing, on an enlarged scale, an essential portion of the modification of FIG. 6.

Before the description of the present invention proceeds, it is to be noted that like parts are designated by like reference numerals throughout several views of the accompanying drawings.

In the first place, it is to be noted that the compressor according to the present invention is so constructed that oil under high pressure is supplied between relatively moving surfaces of the rotor and the end walls of the compressor, while, for example, a ring-like or annular groove concentric with respect to the rotor shaft for the rotor is formed in each of said relatively moving surfaces, and a fluid thrust bearing of the dynamic pressure type is further formed between said annular groove and rotor shaft for eliminating various problems inherent in the conventional rotary type compressors of this kind. In the compressor according to the present invention as described above, particular attention is directed to the formation of the fluid bearing under high pressure with less gasification of refrigerant, whereby a superior seizure prevention effect which is not present in the conventional compressors, has been achieved.

Referring now to the drawings, there is shown in FIGS. 2 and 3(*a*), a rotary compressor M of the sliding vane type according to one preferred embodiment of the present invention. The rotary compressor M generally includes a cylinder 1 having a cylindrical space V therein constituting vane chamber therein, end walls, i.e. front and rear plates 2 and 3 secured to opposite end faces of the cylinder 1 for closing the vane chamber V thereat, a rotor 4 rotatably mounted within the vane chamber V eccentric to the axis of the chamber V, a plurality of vanes 6 each slidably received in a corresponding sliding groove or slit 15 formed in the rotor 4, a rotor shaft 11 fixed to the rotor 4 for simultaneous rotation therewith and having, at opposite end portions thereof, front and rear end circumferential spiral grooves 7 and 5, the grooved parts being rotatably supported in the front and rear plates 2 and 3 in openings 2*a* and 3*a* respectively formed in said plates 2 and 3. The end of the rotor shaft 11 having the grooves 7 further extends outwardly from the front plate 2 through a mechanical seal 8 and has mounted thereon a pulley 10, a clutch 9, etc., and an oil tank is coupled to the vane chamber V at the end face of the rear plate 3 remote from the rotor 4.

It is to be noted here that in FIG. 3(*a*), the rotor 4, vane 6, inner wall of the cylinder 1 and sliding groove for the vane 6, are shown by chain lines for schematic representation.

The compressor M has an annular or ring-like groove 12 formed in the face of the rear plate 3 confronting the rotor 4 in a concentric relation with respect to the rotor shaft 11, a herringbone thrust bearing 13 including outer grooves 13*a* and inner grooves 13*b* formed in the face of the rear panel 3 in a position between said annular groove 12 and the rotor shaft 11, and an oil flow passage 14 formed in the rear panel 3 and communicated with the interior of the tank T in which oil F is contained, for supplying the oil to said annular groove 12 and also to a variable volume chamber or clearance 16 provided between the rear edge of each vane 6 and the inner end of the corresponding sliding groove 15 for accommodating the vane in the rotor 4, with the clearances 16 for each of the vanes 6 being communicated with each other through said annular groove 12.

It should be noted that although the annular groove 12 and herringbone thrust bearing 13 are, for brevity, described with reference only to the rear plate 3 in the foregoing embodiment, the front plate 2 may also be provided with another annular groove 12' and herringbone thrust bearing 13' similar to the annular groove 12 and herringbone thrust bearing 13 as described above.

In the above arrangement, upon rotation of the rotor 4, the respective vanes 6 are slidingly moved within the corresponding sliding grooves 15 of the rotor 4, and thus, volumes of the clearances 16 as described above are periodically varied to a large extent.

Accordingly, the oil (i.e. viscous fluid including, for example, Freon gas dissolved in oil) confined in the clearance 16 repeatedly flows into and flows out of said clearances, but due to the fact that the volume variations in, for example, four clearances are out of phase but at uniform phase intervals, entry and discharge of the fluid is generally balanced, and the fluid comes into and goes out of the respective clearances through the annular groove 12 as a communicating path, although a leakage component $\Delta Q$ thereof flowing out into the vane chamber V is replenished from the tank T provided at the rear side of the compressor M through the oil flow passage 14, as shown by the arrows B in FIG. 3(*a*).

In the foregoing embodiment, since the annular groove 12 having a depth of several mm and filled with the oil is formed around the outer periphery of the herringbone thrust bearing 13, and the outer grooves 13*a* of the thrust bearing 13 feed the fluid under pressure in the direction toward the axis of shaft 11, while the inner grooves 13*b* thereof direct the fluid under pressure in the centrifugal direction, pressures are consequently produced as shown in FIG. 3(*b*). The front plate 2 is also provided with the herringbone thrust bearing 13' similar to the thrust bearing 13 as described earlier and by these two thrust bearings 13 and 13', the rotor 4 is restricted against movement in the axial direction. The herringbone thrust bearing 13 may be a known dynamic pressure type fluid thrust bearing which has a shallow groove pattern of several ten microns formed by a fine processing such as etching or the like.

The present invention is particularly characterized in that the dynamic pressure type fluid thrust bearing operates at a high pressure in which the refrigerant dissolved into the oil is substantially prevented from being gasified.

Mainly for the purpose of preventing leakage of the mixed flow of oil and refrigerant, the present inventors have already investigated and proposed a method of forming, for example, a dynamic pressure seal such as spiral grooves and the like in such a manner as to cover the peripheral portion of the annular groove 12. Since the method as described above simultaneously provides the effect of a dynamic pressure bearing, it is also effective for the prevention of seizure, as compared with the conventional methods relying only on the lubrication by the "heat wedge" action alone.

Owing to the fact that the oil leaks as shown by the arrows B in FIG. 3(*a*), a pressure gradient is present in the range of $a<x<b$ between the rotor 4 and front panel 3 as shown in FIG. 3(*b*), and the pressure reduction as described above is particularly remarkable on the suction side of the cylinder 1. Meanwhile, the solubility of the refrigerant in the oil is lowered as the pressure decreases.

In the graph of FIG. 4 showing the relation between the solubility by weight of the refrigerant (Freon gas R21 in this embodiment) in mineral oil for respective pressures, it is seen that, although the refrigerant has solubility of 33% under the discharge side pressure $P1=14$ kg/cm$^2$, the solubility is reduced to only 2% under the suction side pressure $P2=2$ kg/cm$^2$. In other words, the oil leakage from the annular groove 12 to the vane chamber V is to be gasified by the amount equivalent to the difference $33-2=31\%$ in solubility.

On the other hand, in the case where air bubbles are mixed into the lubrication oil, especially when the oil having an emulsion-like appearance is introduced into the bearing surfaces, lowering of the load capacity of the bearing occurs due to compressibility of the air bubbles and reduction of apparent viscosity, thus giving rise to undesirable seizure of the bearing. The reason for the above inconvenience is that, in the non-compressive viscous fluids, under the extreme condition of clearance $\epsilon \rightarrow 0$ due to eccentricity of the bearing, a pressure which is theoretically infinite may be expected to be developed, while pressure generated in where compressibility of fluids is not negligible due to the mixing of air bubbles, depends on the volume ratio of the air bubbles to oil, and maintains a finite value even in a extreme case.

According to the present invention, the fluid bearing is formed at the position where the fluid lubrication conditions are more favorable, and thus, seizure during high spped operation may be more effectively prevented. The reason for the above advantage is such that in the lubrication of the peripheral portion of the annular groove 12, i.e. for the sliding surface on the end toward the vane chamber V of the cylinder 1, the fluid in the form of an emulsion of the gasified refrigerant and oil is employed as described earlier, while in the lubrication between the annular groove 12 and rotary shaft 11, i.e. lubrication on the sliding surface in the vicinity of the central portion of the rotor 4, a viscous fluid in which the refrigerant has been almost completely dissolved in the oil, is used.

As observed from the annular groove 12 which is an oil supply source, in the section $a<x<b$ where the fluid flows out centrifugally, the fluid passage is divergent where it is communicated with the low pressure side, while in the section $c<x<d$ which is axially directed, the fluid passage is narrowed toward the end and the fluid pressure is not readily lowered, and therefore, the leakage fluid has a large fluid resistance.

In the foregoing embodiment, the end portion of the rotor shaft 11 in the rear plate 3 has circumferential spiral grooves 5, and the back side of the plate 3 has a closed construction, and the end portion of the rotor shaft 11 in to the front side plate 2 similarly has the radial spiral grooves 7 and is closed by the mechanical seal 8. Therefore, by the dynamic pressure effect of the thrust bearings 13 and 13', the pressure on the bearing surfaces is raised higher than the supply pressure for the annular groove 12, and thus, gasification of the refrigerant can be prevented as far as possible for effecting lubrication with an ideal viscous fluid.

In the compressor according to the present invention, owing to the presence of the fluid dynamic pressure effects with a large spring rigidity which acts to maintain clearances uniform, the clearances may be set as small as practicable. Accordingly, since the clearances may be kept to a minimum due to the dynamic pressure effects of the fluid thrust bearings 13 and 13', the fluid resistance of the fluid radially flowing out as shown by the arrows B in FIG. 3(*a*) can be increased for bringing about improvement of the leakage preventing effect.

It should be noted here that in the compressor according to the present invention, the annular groove 12 formed in the relatively moving surfaces of the side plate 3 and the rotor 4, also has an effect for stabilizing the movement of the vanes 6 in the foregoing embodiment, in addition to the function thereof as a high pressure oil source for the herringbone thrust bearing 13 formed between the rotary shaft 11 and the annular groove 12 as described earlier. As the rotor 4 rotates, the vanes 6 move outwardly due to centrifugal force, with the end portions thereof sliding along the inner peripheral surface of the cylinder 1 during rotation.

It is to be noted, however, that, in the case where the rotary compressor of the sliding vane type as described above is used as a compressor, for example, for a "car cooler" or the like, it is insufficient in many cases to rely only on the centrifugal force for causing the vanes 6 to run stably.

The reason for this insufficiency as described above is that, in the case of a compressor for a "car cooler", since the speed is reduced to 800 to 1000 r.p.m. during idling operation, the centrifugal force which is proportional to the square of the rotational speed is lowered, thus resulting in an insufficient outward force on the vanes. Particularly, when it is desired to position the sliding grooves 15 in the rotor 4 eccentric for making the vanes 6 sufficiently long so that the compact size and light weight of the compressor can be maintained, the component of the centrifugal force in the direction of the outer face of the vane 6 or Coriolis force, etc. causes a frictional force obstructing the movement of the vane 6, thus giving rise to such trouble as floating or rising of the outer end of the vane 6 from the inner wall surface of the cylinder 1.

Meanwhile, since the pressure in the closed space defined by the rear end portion of the vane 6 and the corresponding portion of the sliding groove 15 varies at all times due to variations of the volume thereof, and in the case of the compressor in the foregoing embodiment, the volume of the closed space at the rear end portion of the vane 6 is rapidly increased especially in the vicinity of the suction port, a negative force reducing the jumping out force of the vane is developed. Repeated rising and settling of the vanes 6 in the sliding grooves 15 in the above described manner constitute a large factor causing generation of vibrations.

For overcoming the disadvantages as described above, it is extremely effective for the stabilization of the vanes 6 to form the annular groove 12 in the end plate 3 (or alternatively, an arcuate groove) connecting the clearances 16 at the rear portions of the vanes 6 with each other and to supply the oil under high pressure communicated with the discharge side pressure, into the annular groove 12 as shown in FIG. 3(*a*) so as to simultaneously serve as an oil pressure source for the present embodiment. In the above arrangement, since the oil under high pressure is applied to the rear end portions 16 of the vanes 6, stable movement of the vanes 6 can be achieved especially in the vicinity of the suction port where the vanes 6 tend to be raised in the case of the present embodiment.

However, the above arrangement still has a problem in that the compression efficiency of the compressor tends to be lowered.

Since the oil is pressurized by the refrigerant or Freon gas the temperature of which is raised by the high pressure at the discharge side, said oil leaks radially and flows into the vane chamber of the cylinder 1 as shown by the arrows B (FIG. 3(*a*), thus bringing about a large reduction in the volume efficiency especially during the low speed operation. Although the amount of the oil and refrigerant leaking is proportional to the cube of the clearance volume, the compressor according to the present invention is also capable of preventing the undersirable leakage of refrigerant, since the clearances may be minimized as much as possible.

It should be noted here that, in the foregoing embodiment, although the herringbone spiral grooves are employed for the thrust bearing for seizure prevention, for example, as shown in FIG. 3(*a*), the grooves may be replaced by spiral grooves which function for feeding the oil under pressure only in the direction toward the axis of shaft 11 as shown in the modification of FIGS. 5(*a*) and 5(*b*) to be described hereinbelow.

In the modified compressor MB shown in FIGS. 5(*a*) and 5(*b*), in which like parts are designated by the same reference numerals, the herringbone spiral grooves for the thrust bearing 13 described as employed in the arrangement of FIGS. 2 and 3(*a*) are replaced by the spiral grooves for the thrust bearing 130 having the pressure feeding action only in the direction toward the axis of shaft 11.

The length l1 of the part of shaft 11 having circumferential spiral grooves 7*b* which is toward the rotor 4 and the length l2 of the part of the shaft 11 having circumferential spiral grooves 7*a* thereof which is toward the mechanical seal 8 are the relation $l2>l1$, and thus, the extra pressure feeding action of the thrust spiral grooves 130 is compensated by the unbalanced distribution of the circumferential spiral grooves. By the above arrangement, the pressure applied to the mechanical seal 8 may be reduced.

Since other constructions and effects of the modified compressor MB are generally similar to those of the arrangement of FIGS. 2 and 3(*a*), a detailed description thereof is omitted here for brevity.

Referring to FIGS. 6 and 7, there is shown another modification of the compressor of FIGS. 5(*a*) and 5(*b*), in which means are provided to prevent the leakage of refrigerant still more effectively.

In the modified compressor MC of FIGS. 6 and 7, the spiral grooves 130 described as employed in the arrangement of FIGS. 5(*a*) and 5(*b*) are replaced by seizure preventing grooves 230 like grooves 13 of FIGS. 2 and 3 and formed between the annular groove 12 and the rotary shaft 11, while further sealing grooves G are formed around the outer periphery of the annular groove 12, and the end of the rotary shaft 11 being provided, for example, with spiral grooves 5'. The sealing grooves G provide a leakage prevention effect by directing leaking fluid under pressure in the direction toward the axis of shaft 11 as shown by the arrows F in FIG. 6, in addition to the dynamic pressure bearing effect. Since the clearance at the rotor end can be made smaller due to the provision of the seizure prevention grooves 230, and the leakage prevention effect of the sealing groove G is improved as the clearance is reduced, a synergistic effect is achieved by the two kinds of grooves 230 and G. It is to be noted that the seizure prevention grooves 230 and the sealing grooves G need not necessarily be the same depth.

When the clearance at the rotor end is represented by $\delta$ and the depth of the spiral grooves (or alternatively, the herringbone grooves) is denoted by h, the maximum thrust load capacity is normally achieved when the relation is $\delta \simeq h$.

Accordingly, in the modification of FIGS. 6 and 7, the seizure prevention grooves 230 for obtaining the maximum load capacity for effective seizure prevention are given a depth in the relation $\delta \simeq h1$, while the sealing grooves G intended to prevent leakag are given a depth in the relation $\delta > h2$.

It should be noted here that the spiral grooves (or alternatively, herringbone grooves) employed in the foregoing embodiments are so shaped that the lubricating liquid will be given a pumping action in the direction toward the axis of shaft 11 through rotation of the relatively moving surfaces, and therefore, the configuration of the groove pattern is not limited to the above, but may be modified in various ways into any shape. For example, the groove pattern need not necessarily be in the curved spiral shape, but may consist of linear grooves having faces inclined with respect to the radial direction.

It should also be noted that the thrust bearing to be formed between the annular groove and rotor shaft where gasification of the refrigerant is small (or between the rear end portions of the vanes and rotor shaft), need not necessarily be spiral grooves, but may be replaced by a step-land bearing in which the groove depth is varied in a stepped manner in the circumferential direction, so far as the fluid dynamic pressure effect is available.

It should further be noted that the grooves need not necessarily be formed in the side plates, but may be formed in the confronting rotor face, and that although the annular groove is provided to serve as the uniform oil supply source around the periphery of the bearing in the foregoing embodiments, it may be modified to be an arcuate groove conventionally employed for the stabilization of the vane movement. Furthermore, in the foregoing embodiments, although the present invention is described with reference to rotary compressors of the sliding vane type having round circular cross-section cylinders, the present invention is of course applicable to compressors having cylinders, for example, of elliptic cross section and the like as well.

The effects achieved by the construction of the present invention may be summarized as follows.

(1) By the axial direction supporting function for the rotor, the construction is particularly effective for the prevention of seizure at high speed operations.

(2) Since the clearances at the rotor ends can be made small, undersirable leakage of the refrigerant can be appreciably reduced, with consequent improvement of volume efficiency.

(3) Owing to the decrease of entry of oil into the refrigeration cycle, improvement of refrigeration cycle efficiency can be achieved.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be constructed as being included therein.

What is claimed is:

1. A compressor which comprises:

a cylinder having a hollow interior;

a rotor member rotatably eccentrically mounted in said hollow interior and having a plurality of outwardly open sliding recesses therein;

a plurality of vanes slidably mounted in corresponding sliding recesses and extending outwardly into sliding contact with the inner surface of said cylinder;

a rotor shaft on said rotor having the ends extending from the opposite ends of said rotor;

end plates secured to opposite ends of said cylinder and closing said hollow interior for defining a vane chamber in said cylinder, said ends of said rotor shaft being rotatably supported on said end plates, and the surfaces of said end plates and the surfaces of the ends of said rotor being in spaced opposed relationship to define a clearance therebetween, at least one of said opposed surfaces at at least one end said rotor having a ring-like groove therein spaced radially outwardly from said rotor shaft and into which the inner ends of said sliding recesses are open;

means for supplying a liquid lubricant under pressure into said ring-like groove; and a dynamic pressure type fluid thrust bearing in said surface in which said ring-like groove is positioned and being between said ring-like groove and said rotor shaft, and including a plurality of grooves in said surface extending from said ring-like groove to said rotor shaft.

2. A compressor as claimed in claim 1 in which said ring-like groove is an annular groove.

3. A compressor as claimed in claim 1 in which said ring-like groove is an arcuate groove.

4. A compressor as claimed in claim 1 in which said ring-like groove and said thrust bearing are in one of said end plates.

5. A compressor as claimed in claim 1 in which said ring-like groove and said thrust bearing are in both end plates.

6. A compressor as claimed in claim 1 in which said dynamic pressure type fluid thrust bearing has grooves having a shape for feeding lubricant under pressure from said ring-like groove toward said rotor shaft.

7. A compressor as claimed in claim 6 in which said grooves are herringbone shaped grooves.

8. A compressor as claimed in claim 6 in which said grooves are spiral grooves.

9. A compressor as claimed in claim 1 in which said surface in which said ring-like groove is positioned further has further grooves therein extending outwardly away from said rotor shaft, and having a shape for pumping lubricant inwardly toward said rotor shaft.

10. A compressor as claimed in claim 1 in which the clearance between said opposed surfaces and the depth of said grooves in said thrust bearing are approximately equal.

* * * * *